United States Patent [19]

Porlier

[11] 4,282,870

[45] Aug. 11, 1981

[54] BREATHING MIXTURE CONTROLLER

[75] Inventor: Joseph G. A. Porlier, Downsview, Canada

[73] Assignee: Her Majesty the Queen in right of Canada, as represented by the Minister of National Defence, Ottawa, Canada

[21] Appl. No.: 56,731

[22] Filed: Jul. 11, 1979

[51] Int. Cl.[3] ..... A62B 7/00

[52] U.S. Cl. ..... 128/203.14; 128/204.29; 244/118.5

[58] Field of Search ..... 128/203.14, 203.25, 128/204.22, 204.29; 137/487.5, 81

[56] References Cited

U.S. PATENT DOCUMENTS

| | | | |
|---|---|---|---|
| 3,587,438 | 6/1971 | Foster et al. | 128/204.22 |
| 4,109,509 | 8/1978 | Cramer et al. | 128/204.22 X |
| 4,188,946 | 2/1980 | Watson et al. | 128/204.22 |

*Primary Examiner*—Henry J. Recla

*Attorney, Agent, or Firm*—Cushman, Darby & Cushman

[57] ABSTRACT

A breathing mixture controller is provided for use with oxygen generators and consists of a sensing means adapted to receive a portion of the breathing mixture and to sense the partial pressure of oxygen in the breathing mixture at cabin pressure, an aneroid controlled valve positioned in the flow to cut off the flow at higher altitudes, and a valve coupled to the sensing means for controlling the flow dependent upon the partial pressure of oxygen in the breathing mixture.

4 Claims, 2 Drawing Figures

BREATHING MIXTURE CONTROLLER

This invention relates generally to oxygen generators of the type used in aircraft pilot life support systems to draw gases from engine bleed air and to provide oxygen to the pilot, and more particularly to a device adapted to be inserted in the life support system to cause an excess demand on the oxygen generator at lower altitudes so that an oxygen/nitrogen mixture is drawn from the generator.

At high altitudes pilots of military aircraft require a life support system to provide the necessary breathing mixture. At very high altitudes in excess of about 17,500 feet (cabin) the pilot requires almost pure oxygen supply for his breathing requirements. Conventionally a cylinder of oxygen was provided together with a regulator and mask. However, at lower altitudes the pilot requires only a mixture of air with the oxygen and this is provided automatically by a complex regulator which operates in proportion to altitude.

It has been proposed more recently to use air from outside the aircraft and in particular to collect a small fraction of the bleed air from an engine and to use this as the basis for the pilot's breathing mixture. The bleed air is filtered by a molecular filter or sieve. The gas leaving the filter consists almost essentially of oxygen although because of the molecular structure of argon, a small percentage of argon (about 5%) is also present. At lower altitudes it is advantageous to mix the gas coming from the filter with air in order to provide nitrogen in the breathing mixture thereby preventing lung atelectasis induced by positive "g" forces when breathing pure oxygen.

It has been found that one of the characteristics of the oxygen generator is that when it is overloaded it permits nitrogen to pass as well as oxygen. The present invention takes advantage of this characteristic and in effect causes an excess flow from the oxygen generator at lower altitudes so that the resulting breathing mixture includes nitrogen. The invention provides an arrangement whereby the nitrogen content varies with altitude so that the pilot while breathing normally and gaining altitude will commence at ground level with a normal breathing mixture and will receive almost pure oxygen at higher altitudes.

In accordance with one of the aspects of the invention a device is provided for use with oxygen generators and consists of a sensing means adapted to receive a portion of the breathing mixture and to sense the partial pressure of oxygen in the breathing mixture at cabin pressure, an aneroid controlled valve positioned in the flow to cut off the flow at higher altitudes, and a valve coupled to the sensing means for controlling the flow dependent upon the partial pressure of oxygen in the breathing mixture.

Figure 1:
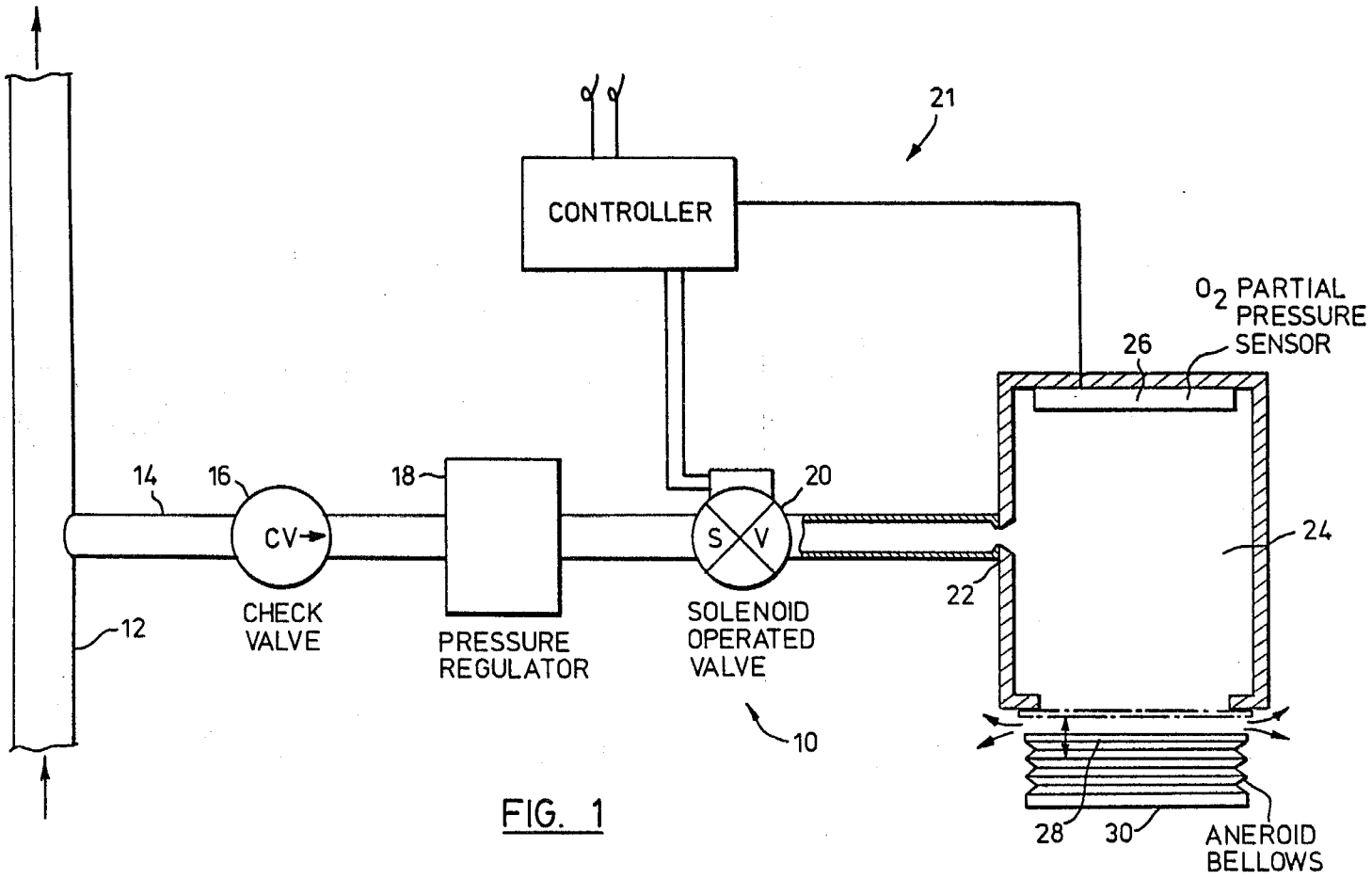
Figure 2:
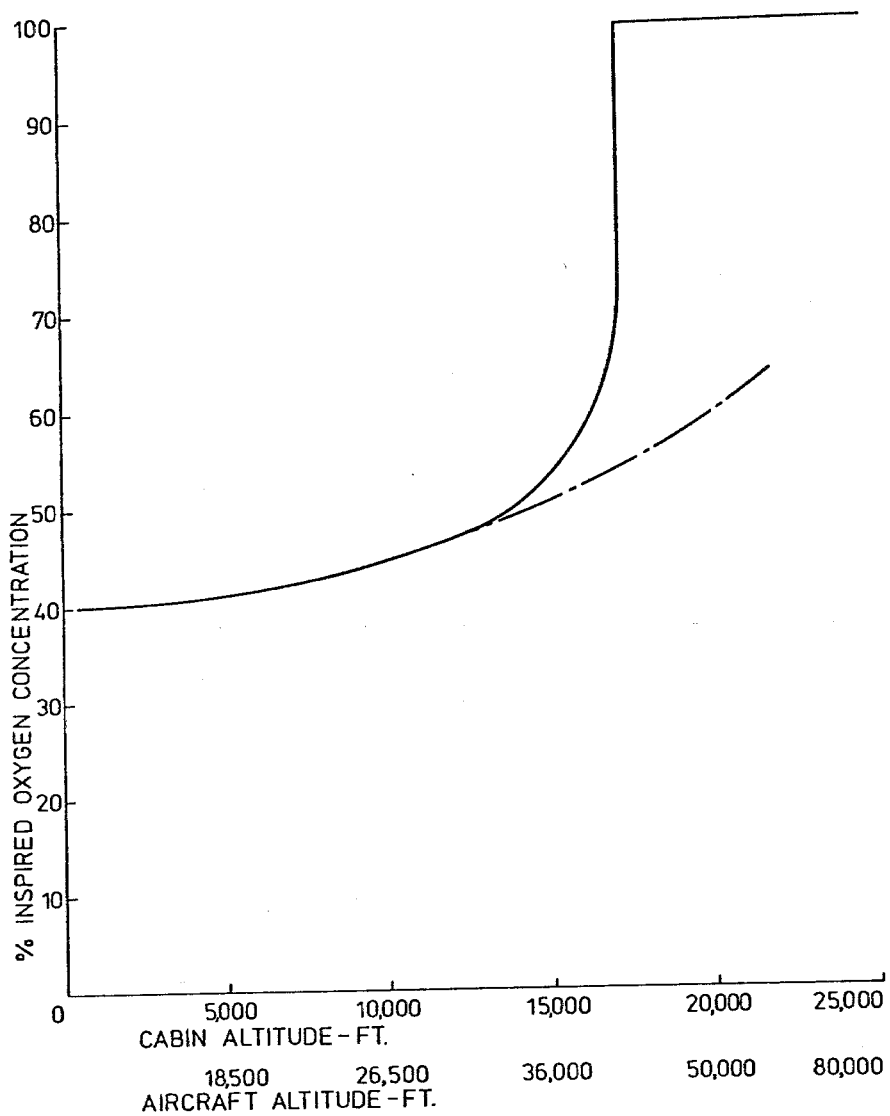

This and other aspects of the invention will be better understood with reference to the drawings and the following description wherein:

FIG. 1 is a diagramatic representation of a device according to a preferred embodiment of the invention; and FIG. 2 is a graph showing the preferred relationship between inspired oxygen concentration received by the pilot and the altitude of the aircraft.

Reference is first made to FIG. 1 which illustrates diagramatically a device indicated generally by the numeral 10 and coupled to a feeder pipe 12 which leads breathing mixture from an oxygen generator (not shown) to the pilot. The structure of the device will be described initially followed by a description of its operation with reference also to FIG. 2.

As seen in FIG. 1, breathing mixture from the feeder pipe 12 enters an inlet 14 of the device 10 and meets a one-way check valve 16 which is placed in the device simply to avoid pilot inhalation via the device. The breathing mixture then passes to a pressure regulator 18 where the pressure is dropped before it meets a solenoid operated valve 20. This valve forms part of a control system 21 capable of following a pre-selected oxygen partial pressure as will be described. The breathing mixture then continues from the solenoid operated valve 20 by way of a venturi 22 into a chamber 24 which is substantially at cabin pressure. The chamber contains an oxygen partial pressure sensor 26 which also forms part of the control system 21.

The chamber 24 has a large opening at the bottom end (as drawn) and this can be closed by a sealing pad 28 formed on the surface of an aneroid bellows 30. This bellows would be in the position shown at lower altitudes and as the cabin altitude approaches 17,500 feet the bellows would move into the position shown in ghost outline to seal the outlet from the chamber 24.

The control system 21 is in effect a servosystem. It takes information from the partial pressure sensor 26 and controls the solenoid operated valve 20 so that the flow rate through the device is made to match that required for a given partial pressure of oxygen as will be described.

Reference is now made to FIG. 2 to describe the requirements of a pilot as an aircraft reaches very high altitudes. Cabin pressure is controlled and lags well behind actual aircraft altitude as indicated on the abscissa of the graph. The solid line represents the preferred relationship between cabin altitude (and therefore aircraft altitude) and the percentage inspired oxygen concentration. It will be seen that at zero altitude the percentage concentration is maintained at about 40%. As the aircraft climbs the requirement increases until at about 14,000 feet (cabin) there is a requirement that the oxygen be about 60% concentration. This demand increases dramatically from this point onwards reaching theoretically 100% at about 17,500 feet (cabin). Then of course it continues at this level as the aircraft climbs further.

The graph shown in FIG. 2 also illustrates a continuation of the bottom part of the solid line and this continuation is shown in ghost outline. The continuation represents a constant partial pressure for oxygen and in effect provides the lower end of the theoretical graph required by the pilot. This partial pressure is about 200 mm. of mercury (+ or −20 mm.) and can only be maintained constant as the aircraft gains altitude by increasing the percentage of inspired oxygen concentration in the breathing mixture. However, although the lower part of the curve of partial pressure is acceptable at lower altitudes, it becomes necessary to control the percentage of oxygen by more direct relation to altitude as the aircraft approaches 17,500 feet (cabin). Consequently the control must be two-fold in order to get the required theoretical curve. First, at the lower parts it follows the partial pressure of oxygen curve and then it is controlled by a combination of the oxygen curve and altitude control. Above about 70% inspired oxygen it results exclusively from altitude control.

Returning to FIG. 1. it will be seen that the control system 21 provides control of the partial pressure at the lower end of the curve shown in FIG. 2. In practice, when the pilot is flying the aircraft at lower altitude the oxygen generator would provide a normal 95% (or thereabouts) oxygen. However, because of the partial pressure setting in the control system 21, the solenoid operated valve would be wide open causing a bleed through the device 10 which would in effect create a larger demand on the oxygen generator. As a result nitrogen passes through the oxygen generator and the breathing mixture of oxygen and nitrogen is sensed by the control system 21 which then in effect sets the solenoid operated valve to maintain the preset partial pressure as the aircraft gains altitude up to about 13,000 feet. At this point, the aneroid bellows begins to close off the opening from the chamber 24 and in effect begins to restrict flow through the device. Consequently as this restriction slows down the flow through the device, the demand on the oxygen generator is reduced, and consequently the oxygen percentage concentration received by the pilot increases. This continues to the point where the aneroid bellows closes the chamber 24 completely cutting off flow through the device. The control system responds by opening the solenoid valve fully in an attempt to reduce the partial pressure, but of course there is no flow and the device becomes inactive.

When the pilot begins to descend a point will be reached where the aneroid bellows permits flow to commence through the device and again the control system 21 will attempt to bring down the partial pressure by providing full flow. This flow, however, will only be achieved when the pilot drops to about 14,000 feet when the aneroid bellows permits full flow and the control system 21 again controls the partial pressure and in effect the percentage of inspired oxygen concentration in the lower part of the curve shown in FIG. 2.

It will be appreciated that the form of the curve shown in FIG. 2 can be varied by choosing different partial pressures of oxygen and by the fluid dynamic control of the breathing mixture through the device. That portion of the curve shown in FIG. 2 which in effect blends the lower part to the upright part is a function of the rate of closing of the aneroid bellows. If the aneroid bellows is made to close quickly then the curve will have a more abrupt change of slope and conversely if it closes slowly then a more rounded portion could be provided in the curve.

It will now be appreciated that the control system senses the partial pressure of oxygen and attempts to maintain a preset partial pressure by changing the rate of flow of breathing mixture through the device. This control is adequate at lower altitudes, but is in effect rendered inactive at higher altitudes by the aneroid bellows which gradually closes off the device and makes it inactive at higher altitudes.

In the event that the pilot suddenly requires a larger breathing mixture supply, this demand will effectively decrease the oxygen concentration momentarily until the control system reacts to limit the flow through the device. Consequently the device will have little effect on the oxygen generator response in such circumstances.

The embodiments of the invention in which an exclusive property or privilege is claimed are defined as follows:

1. In an aircraft breathing system including an oxygen generator of the type used in pilot life support systems to draw gases from engine bleed air and to provide oxygen to the pilot and which generates oxygen/nitrogen mixture when overloaded, a device to cause an excess demand on the oxygen generator at lower altitudes so that a variable oxygen/nitrogen breathing mixture is drawn from the generator, and at higher altitudes a higher oxygen concentration breathing mixture is drawn from the generator, the device comprising:

inlet means for receiving a portion of breathing mixture from the life support system in parallel to the pilot's demand on the system;

means defining a chamber having substantially cabin pressure therein for receiving said portion;

an oxygen partial pressure sensor contained in the chamber means to sense the partial pressure of oxygen in the breathing mixture;

a valve positioned between the inlet and the chamber means and operable to change the rate of flow of breathing mixture to said chamber;

control means coupled to the sensor and to the valve, the control means controlling the valve dependent on the sensed partial pressure of the oxygen so that if the partial pressure deviates from a predetermined pressure the valve is moved to adjust the rate of flow of said portion until the predetermined partial pressure is sensed by said partial pressure sensor so that at lower altitudes as the flow rate increases, an excess demand is created on the generator and a lower oxygen concentration breathing mixture is produced; and means sensitive to cabin pressure to prevent flow of said portion at higher altitudes when the cabin pressure is above a predetermined limit so that the device is then inoperative and the pilot receives a suitable higher oxygen concentration breathing mixture from the generator.

2. A device according to claim 1, wherein said valve is a solenoid operated valve.

3. A device according to claim 1, wherein said means sensitive to cabin pressure is an aneroid controlled valve positioned in the flow of said portion of said breathing mixture as this portion leaves the sensing means, to close off the flow of breathing mixture at a pre-determined cabin pressure.

4. A method of modifying a breathing mixture delivered to an aircraft pilot dependent on aircraft altitude, the method comprising:

providing an oxygen generator that generates an oxygen/nitrogen breathing mixture when overloaded;

providing a primary flow path from said oxgyen generator to a pilot;

providing a secondary flow path from said primary flow path for a portion of the breathing mixture;

sensing the partial pressure of oxygen in said portion and controlling the flow rate along the secondary flow path dependent on a predetermined required partial pressure such that as the aircraft climbs in a range of lower altitudes, the flow rate of said portion is decreased thereby decreasing the demand on said generator and increasing the oxygen concentration from said generator to maintain the predetermined partial pressure in the secondary flow path; and sensing cabin pressure to cut off the flow of said portion through said secondary flow path at higher altitudes so that this flow ceases and demand on the generator decreases so that the oxygen concentration in the breathing gas mixture increases.

* * * * *

UNITED STATES PATENT AND TRADEMARK OFFICE

CERTIFICATE OF CORRECTION

PATENT NO. : 4,282,870

DATED : August 11, 1981

INVENTOR(S) : Joseph G.A. Porlier

It is certified that error appears in the above-identified patent and that said Letters Patent are hereby corrected as shown below: ON THE TITLE PAGE INSERT:

-- (30) Foreign Application Priority Data

June 12, 1979 Canada..... 329,610 --.

Signed and Sealed this

*Twenty-fourth* Day of *November 1981*

[SEAL]

*Attest:*

GERALD J. MOSSINGHOFF

*Attesting Officer*

*Commissioner of Patents and Trademarks*